United States Patent [19]

Clark et al.

[11] Patent Number: 4,601,604

[45] Date of Patent: Jul. 22, 1986

[54] EXPANSION JOINT

[75] Inventors: John R. G. Clark; Philip J. Wade, both of Frome, England

[73] Assignee: ALH Systems Limited, Wiltshire, England

[21] Appl. No.: 516,852

[22] Filed: Jul. 25, 1983

[30] Foreign Application Priority Data

Jul. 23, 1982 [GB] United Kingdom ..... 8221352

[51] Int. Cl.[4] ..... E01C 11/02; E01C 11/10

[52] U.S. Cl. ..... 404/69; 404/66; 404/67; 404/74; 52/396; 52/403

[58] Field of Search ..... 404/64–69, 404/49, 74; 52/573, 396, 403

[56] References Cited

U.S. PATENT DOCUMENTS

| | | | |
|---|---|---|---|
| 749,765 | 1/1904 | Wight | 52/396 |
| 2,431,385 | 11/1947 | Fischer | 404/49 |
| 2,849,935 | 9/1958 | Martin | 404/49 |
| 3,387,544 | 6/1968 | MacLellan et al. | 404/68 X |
| 3,406,087 | 10/1968 | Potter | 404/64 X |
| 3,629,986 | 12/1971 | Klittich | 404/64 X |
| 3,827,204 | 8/1974 | Walters | 404/66 X |
| 4,295,311 | 10/1981 | Dahlberg | 52/396 |

FOREIGN PATENT DOCUMENTS

| | | | |
|---|---|---|---|
| 644713 | 4/1937 | Fed. Rep. of Germany | 404/67 |
| 576031 | 3/1946 | United Kingdom | 404/67 |
| 1510622 | 5/1978 | United Kingdom | 404/66 |

*Primary Examiner*—Stephen J. Novosad
*Assistant Examiner*—John F. Letchford
*Attorney, Agent, or Firm*—Larson and Taylor

[57] ABSTRACT

An expansion joint for sealing the channel between two sections of roadway has a plug and a fluid-polymer poured into the joint and allowed to set in situ in the channel. Enclosed within the fluid is a core of a mastic material which is more plastic and less elastic than the fluid-polymer. The elasticity of the fluid-polymer allows the joint to accommodate changes in the size of the joint due to e.g. thermal expansion and contraction. Plastic flow of the core permits changes of shape of the joint to be absorbed without causing excessive stressing of the sides of the channel to which the fluid-polymer adheres.

10 Claims, 2 Drawing Figures

EXPANSION JOINT

BACKGROUND OF THE INVENTION

1. Field of the Invention

The present invention relates to expansion joints for roadways.

2. Description of the Prior Art

It is common to fill channels or gaps between sections of roadway surfaces with some sort of joint. The gaps occur particularly in bridge decks and viaducts, and the joint seals the gap against ingress of surface water and debris. One type of expansion joint that has been known for a number of years is formed from extruded rubber which connects adjacent sections of roadway. One such joint, for use as a buried joint below the road surface, is disclosed in UK Patent Specification No. 1526194.

A second and more recent type of joint uses fluid-polymers which are poured into the channel which is to be sealed. These are cheaper and easier to install than the extruded rubber joints and also provide fewer problems when the roadway is re-surfaced. With such fluid-polymer joints, the channel between the blocks of the roadway surface is filled with a plug of packing material and the fluid-polymer is poured into the gap. The fluid-polymer then sets in situ. The joint thus produced has a plastic quality, so that if relative movement of the roadway blocks occurs the joint alters shape to fill any resultant gap.

It is also known to provide a rigid core in the fluid-polymer, to minimise impact damage to the fluid-polymer and to act as a support. For example, in U.S. Pat. No. 3,827,204 a tape of glass cloth is provided in the channel between two layers of the settable polymer. In order to prevent the joint from being dislodged from the channel, the fluid-polymer should adhere to the channel.

However the use of a fluid-polymer causes problems. If the set fluid-polymer is plastic in its behaviour then the impact of traffic on the joint has the effect of forcing the fluid-polymer out of the channel and pushing it forward in the direction of the direction of the dominant traffic flow. As the material is plastic, this results in permanent deformation of the joint. Permanent deformation can be avoided by using an elastic fluid-polymer; the fluid-polymer returning to its original shape after deformation. However, this raises a different problem, namely that the elastic deformation puts great strain on the sides of the channel to which the set fluid-polymer adheres. The fluid-polymer material must adhere to the roadway surface sufficiently to prevent it becoming dislodged but also must not load the surface too strongly, otherwise deformation of the joint causes unacceptable stresses in the edges of the roadway.

Thus if the joint is used between the edge of a bridge (normally a concrete surface) and the edge of the approach road (normally an asphalt surface) polymer materials are known which could be used which adhere to both surfaces extremely well. It has been found however that deformation of the joint causes fracture of the edges of the asphalt because the latter is not sufficiently strong to withstand the stresses exerted on it. It has not proved possible to find a fluid-polymer which does not either become permanently distorted or cause unacceptable loading of the roadway surfaces.

SUMMARY OF THE INVENTION

The present invention seeks to obtain the advantages of a fluid expansion joint without the problem of permanent deformation or unacceptable loading. It achieves this by providing a core in the fluid-polymer which is more plastic and less elastic than the set fluid-polymer.

The fluid-polymer adheres to the sides of the channel and holds the joint in the channel. Its elasticity absorbs variations, due to e.g. thermal expansion and contraction in the width of the channel. Under slow variations or under sudden load, e.g. when a vehicle runs over the joint, the core deforms with plastic flow. This deformation of the core is absorbed in the surrounding fluid-polymer thereby permitting the joint to change shape without causing significant strain on the edges of the fluid-polymer adhering to the roadway. When the load is removed, the elasticity of the fluid-polymer causes the core to return to its original shape with plastic flow of the core material. It is desirable that the plastic flow of the core is sufficiently rapid to permit the joint to change shape relatively quickly without being so rapid that the central part of the joint collapses. Mastic materials have been found to have suitable properties.

The core could be water encased in a flexible skin (water being relatively inelastic but flowing easily) but is preferably an extruded mastic material, as this gives a construction that is easier to achieve practically.

Preferably the core is wholly enclosed within the fluid-polymer although it is possible for a part of the core to lie adjacent a part of the plug or channel. However this latter reduces the amount of set fluid-polymer in adhesion with the channel, and hence weakens the adhesion of the joint. Enclosing the core wholly within the fluid-polymer gives maximum adhesion and is hence preferred.

Where concrete roadway blocks have an asphalt covering on their upper surface it is common that the asphalt does not extend to the edge of the concrete blocks so that the channel in the roadway has a first part between the asphalt layers and a second narrower part extending downwards from the first part between the concrete blocks. To provide a joint according to the present invention in such a channel, the narrow part is plugged and the fluid-polymer and core filling the wide part. The core is preferably located over the narrow part and is wider than the part of the channel so that it acts as a support to prevent the joint being forced down the narrow part of the joint.

The present invention also relates to a method of forming an expansion joint. After sealing the channel with a plug, the core may be located as the plug then fluid-polymer poured into the channel until the core is covered. The fluid-polymer is then allowed to set. However, to increase the area of contact between the joint and the channel, it is preferable to pour a first layer of fluid-polymer into the channel above the plug and allow that to set. Then the core is located on that first layer and a second layer of fluid-polymer is poured into the channel and allowed to set. The core is then sealed between the fluid-polymer layers.

BRIEF DESCRIPTION OF THE DRAWINGS

Embodiments of the invention will now be described in detail, by way of example, with reference to the accompanying drawings, in which.

DETAILED DESCRIPTION

Figure 1:
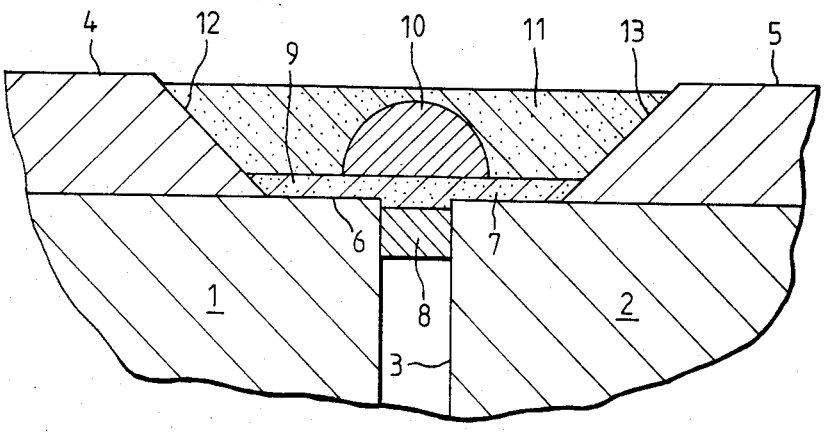
FIG. 1 shows a first embodiment of a joint according to the present invention between two roadway blocks.

Referring first to FIG. 1 adjacent blocks 1,2 of a roadway made of e.g. concrete have a gap 3 between them. The blocks 1 and 2 each have an asphalt layer 4 and 5 respectively on their upper surface, there being short lengths of concrete 6,7 exposed adjacent the gap 3, so that a channel is formed by the gap 3 and the space between the asphalt layers 4 and 5.

To fit a joint according to the present invention, the top of the gap 3 is first filled with a packing material 8 of e.g. polyethylene sponge. A fluid-polymer which is elastic both under compression and tension, such as an amine cured polyeurethane is poured into the gap to form a layer 9 about 1 inch (2.5 cm) above the surfaces 6 and 7 of the concrete blocks 1 and 2 respectively. The packing material 8 prevents the fluid-polymer leaking down the joint 3. The layer 9 of fluid-polymer then sets so that it hardens.

A core 10 of an extruded mastic material which is more plastic and less elastic than the fluid-polymer, such as a butyl based mastic, is placed over the gap 3 on top of the layer 9. The core 10 may be manufactured in the form of extruded and pre-cut lengths. Then more fluid-polymer is poured into the gap between the asphalt layers 4 and 5 until the core 10 is covered completely. This additional fluid-polymer then sets to form a second layer 11, filling the channel and completely the joint. The extruded core 10 illustrated in FIG. 1 has a rounded upper surface which improves the ability of the core 10 to strengthen the elastic material above and around it. Furthermore, if the core 10 is provided in a number of pre-cut lengths, gaps may be left between the lengths so that they are completely surrounded by the layers 9 and 11. The use of an extruded mastic support has the additional advantage that it is cheaper to produce than the surrounding elastic material and therefore reduces the total manufacturing cost of the joint.

As can be seen from FIG. 1 it is preferable that the edges 12,13 of the asphalt layers 4 and 5 respectively are chamfered at an angle of e.g. 45° to increase the area of asphalt which is in contact with the joint. This improves the adhesion of the joint to the asphalt.

The size and shape of the core 10 depend on the channel in which the joint is formed. It has been found that the elasticity of the edges of the fluid-polymer 9,11 is primarily responsible for the expansion and contraction of the joint and the interior of the fluid-polymer 9,11 contributes little. Therefore, since the core 10 is made of cheaper material than the fluid-polymer 9,11 it is preferable to maximise the size of the core 10.

Figure 2:
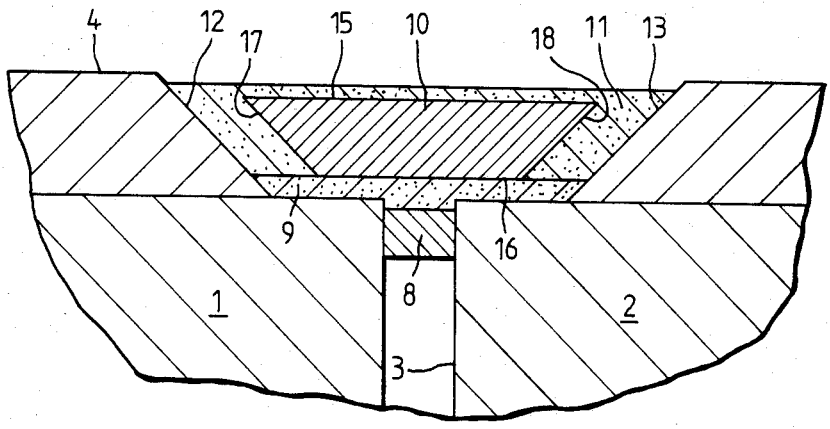
FIG. 2 shows a second embodiment of a joint according to the present invention, generally similar to the embodiment of FIG. 1 but with a differently shaped core.

FIG. 2 shows a joint according to the present invention in which the core 10 has its upper and lower surfaces 15,16 parallel and its side surfaces 17,18 parallel to the adjacent edges 12,13 of the asphalt layers 4,5 respectively so that the core 10 has a frusto-conical cross section. The other elements of the joint of FIG. 2 are the same as those of the joint of FIG. 1. and the same reference numerals are used. Since the joint of FIG. 2 is cheaper to produce and provides a satisfactory joint, it is preferred to the joint of FIG. 1.

What is claimed is:

1. An expansion joint for joining two sections of a roadway, such sections having opposing sides, defining a channel between said sections, said expansion joint comprising:

a plug for sealing said channel;

a set fluid-polymer which sets in situ in said channel, said set fluid-polymer being located in said channel above said plug, such set fluid-polymer adhering to said sides of said sections for holding said joint in said channel; and a core in said set fluid-polymer said core being more plastic and less elastic than said set fluid-polymer.

2. A expansion joint according to claim 1, wherein said core is wholly surrounded by said set fluid-polymer.

3. An expansion joint according to claim 1, wherein said core mastic.

4. An expansion joint according to claim 1, wherein said core is comprises an extruded strip.

5. An expansion joint for joining two sections of a roadway, said sections having opposing sides defining a channel between said sections, said channel having a first part and a second part, narrower than said first part, said second part extending downward from said second part, the expansion joint comprising:

a plug for sealing said second part of said channel;

a set fluid-polymer which sets in situ in said channel, said set fluid-polymer extending upward from said plug and filling said first part of said channel, said set fluid-polymer adhering to said sides of said channel for holding said expansion joint in said channel; and a core in said set fluid-polymer and in said first part of said channel, said core having a width greater than said second part of said channel, said core being more plastic and less elastic than said set fluid-polymer.

6. An expansion joint according to claim 5, wherein said first part of said channel has a frusto-conical cross section with the wider end of said frusto-conical cross section of said part of said channel and said core has a corresponding frusto-conical cross section with sides parallel to the sides of said first part of said channel.

7. A method of forming an expansion joint for joining two sections of a roadway, said sections having opposing sides defining a channel between said sections, the method comprising:

fitting a plug in said channel, said plug sealing said channel;

pouring a first layer of fluid-polymer into said channel above said plug, said first layer of fluid-polymer when set adhering to said sides of said sections;

locating a core on said first layer of fluid-polymer;

pouring a second layer of the fluid-polymer into said channel above said first layer of fluid-polymer to a depth sufficient to cover said core; and allowing said second layer of fluid-polymer to set said second layer of fluid-polymer when set adhering to said sides of said sections;

wherein said core is more plastic and less elastic than the fluid-polymer of said first layer and said second layer of fluid-polymer when said first layer and said second layer of fluid-polymer are set.

8. A method according to claim 7, wherein said core is wholly enclosed between said first layer and said second layer of fluid-polymer.

9. A method according to claim 8, wherein:

said channel has a first part and a second part, said second part extending downwardly of said first part, said second part having a width smaller than the width of said first part;

said plug is fitted in said second part of said channel;

said first layer of fluid-polymer extends from said plug into said first part of said channel; and said core is located wholly within said first part of said channel, said core having a width greater than the width of said second part of said channel.

10. A method of forming an expansion joint for joining two sections of a roadway, said sections having opposing sides defining a channel between said sections, the method comprising:

fitting a plug in said channel, said plug sealing said channel;

locating a core in said channel above said plug;

pouring a fluid-polymer into said channel to a depth sufficient to cover said core; and allowing said fluid-polymer to set, said fluid-polymer when set adhering to said sides of said sections;

wherein said core is more plastic and less elastic than the fluid polymer when set.

* * * * *